US005826738A

United States Patent [19]

Minh

[11] Patent Number: 5,826,738

[45] Date of Patent: Oct. 27, 1998

[54] CHILD-RESTRAINT COMBINATION OF A CONTAINER AND A ONE-PIECE CLOSURE

[76] Inventor: Do Le Minh, 2718 Ashwood Cir., Fullerton, Calif. 92635-2800

[21] Appl. No.: 968,464

[22] Filed: Jun. 24, 1997

Related U.S. Application Data

[63] Continuation of Ser. No. 462,197, Jun. 5, 1995, abandoned.

[51] Int. Cl.[6] ..... A61J 1/00

[52] U.S. Cl. ..... 215/206; 215/223

[58] Field of Search ..... 215/206, 218, 215/221, 222, 223

[56] References Cited

U.S. PATENT DOCUMENTS

| | | | |
|---|---|---|---|
| 3,450,290 | 6/1969 | Turner | 215/206 X |
| 3,478,911 | 11/1969 | Hedgewick et al. . | |
| 3,627,160 | 12/1971 | Horvath . | |
| 3,656,647 | 4/1972 | Swinn | 215/206 X |
| 3,782,574 | 1/1974 | Rumble | 215/206 X |
| 3,865,267 | 2/1975 | Morris . | |
| 3,871,662 | 3/1975 | Hepp et al. . | |
| 4,353,462 | 10/1982 | Polaneczky | 215/206 X |
| 5,148,931 | 9/1992 | Minh . | |
| 5,292,017 | 3/1994 | Reifers . | |
| 5,358,129 | 10/1994 | Watts | 215/206 |
| 5,397,008 | 3/1995 | Glynn | 215/225 |

*Primary Examiner*—Stephen Cronin

[57] ABSTRACT

The present invention relates generally to a child-restraint combination of a container and a one-piece closure. The interior surface of the closure has one type-A lug, and a plurality of type-B lugs. The exterior surface of the container has one type-A groove, and a plurality of type-B grooves. If the user aligns the two side lines, one on the container and one on the closure, before lifting the closure away from the container, then the type-A lug is lifted into the type-A groove, and the closure can be removed very easily from the container. If the user lifts the closure without aligning the two side lines first, then the type-A lug is lifted into one of the type-B grooves, causing the container and the closure interlock, making it impossible to rotate or to lift the closure away from the container.

8 Claims, 7 Drawing Sheets

CHILD-RESTRAINT COMBINATION OF A CONTAINER AND A ONE-PIECE CLOSURE

This application is a continuation of prior application Ser. No. 08/462,197, filed on Jun. 5, 1995, now abandoned.

FIELD OF THE INVENTION

The present invention relates generally to a child-restraint combination of a container and a one-piece closure.

SUMMARY OF THE INVENTION

It is well recognized that there is a potential hazard associated with the use of containers containing toxic materials, medicines, corrosive substances and the like. It is therefore highly desirable that certain persons—notably small children and mentally disturbed persons—be hindered in their ability to open these containers. In fact, it is required by law that those containers have child-restraint closures to discourage small children in their idle attempts to open them.

A principal object of the present invention is to provide a new combination of a container and a closure that can be opened only by persons instructed in its use. It tries to prevent people who do not know how to remove the closure from the container from doing so, rather than requiring the users to use a stronger force than that normally required to remove a non-child-restraint one. Once a person follows the prescribed steps, he or she does not need to exert any strong force to remove the closure from the container.

Another object of the present invention is to provide a new child-restraint combination of a container and a closure that is not too complicated to open, yet sufficiently complicated to prevent a child or a mentally disturbed person from doing so.

Another object of the present invention is to provide a new child-restraint combination of a container and a closure that are not too costly for the design and manufacture, at least not more costly than any existing ones.

Features of the invention useful in accomplishing the above objects include a container and a closure. The interior surface of the closure has lugs of two types, A and B. One of these is of type-A; the rest is of type-B. Similarly, the exterior surface of the container has one type-A groove and a plurality of type-B grooves. If the type-A lug is lifted into the type-B groove, then the container and the closure interlock, making it impossible to remove the closure from the container. On the other hand, if the type-A lug is lifted into the type-A groove, then the closure can be removed very easily from the container. The type-A lug can be lifted into the type-A groove only after the user aligns the two side lines, one on the closure and one on the container.

The foregoing and other objects of the present invention, as well as the present invention itself and its embodiments, may be more fully understood from the following description when read in conjunction with the accompanying drawings.

DETAIL DESCRIPTION OF THE INVENTION

Figure 1:
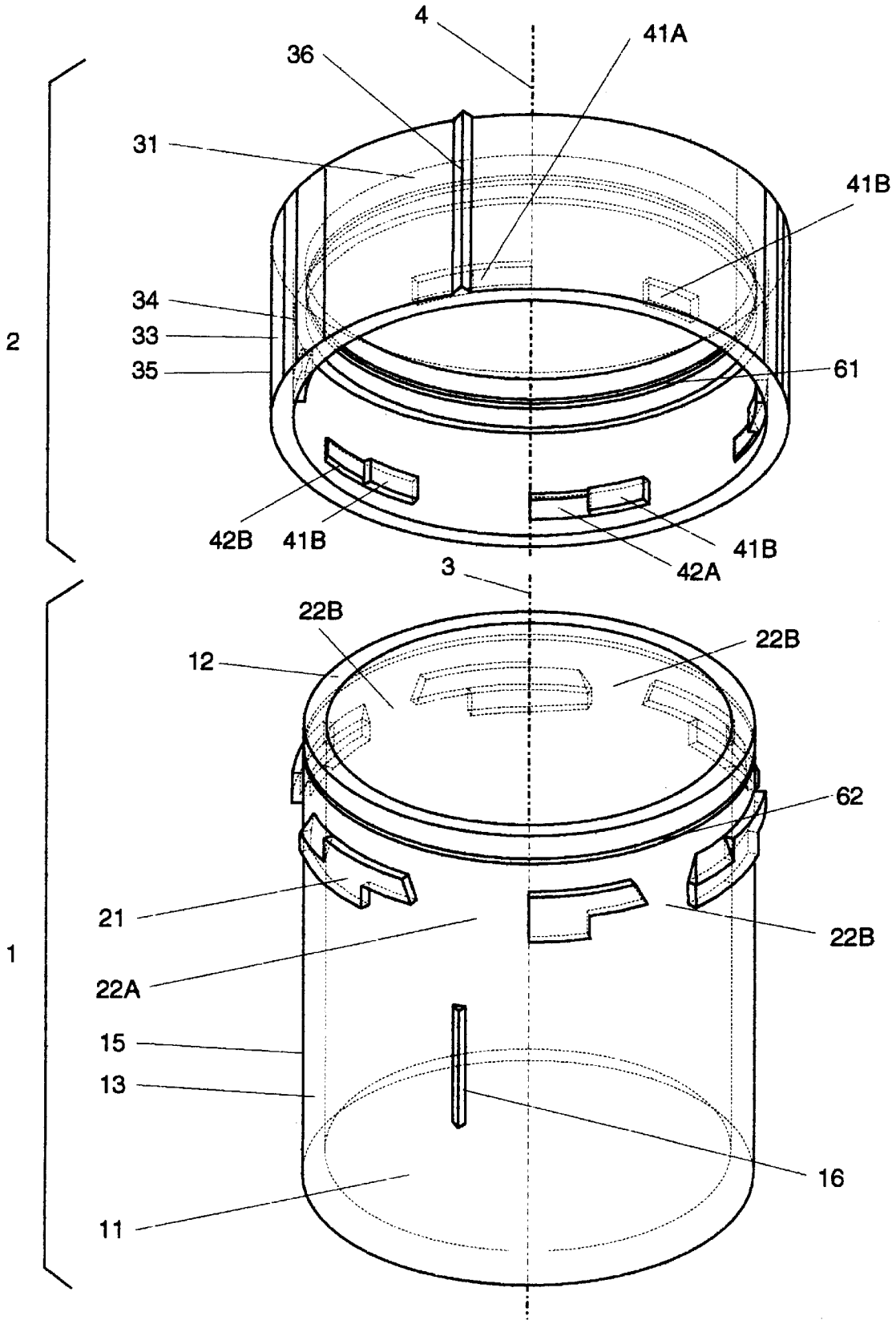
FIG. 1 is a perspective view of the container and the closure.

Referring to FIG. 1, its bottom part shows a container 1 and its top part a closure 2. It is convenient to position them so that they are vertical and the container central axis 3 is parallel to the closure central axis 4.

The container has a bottom panel 11 and a cylindrical container side wall 13, integrally formed therewith and depending from the periphery thereof. Side wall 13 has an upper edge 12 and an exterior surface 15. For any element found on this exterior surface, its left side is defined as the side on the left when we view it toward container central axis 3.

Positioned near upper edge 12 is a plurality of radially outwardly extended protrusions 21. The space between these protrusions define a type-A groove 22A and a plurality of identical type-B grooves 22B. Collectively, they will be referred to as grooves 22.

Figure 3:
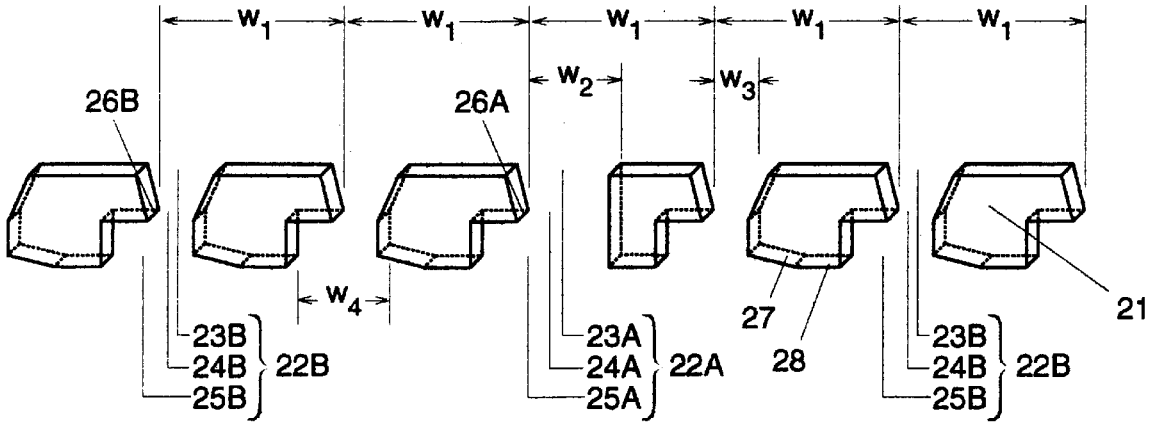
FIG. 3 is a perspective view of the grooves and the protrusions.

As shown in FIG. 3, each groove has (i) an upper opening 23 toward the top of the container; (ii) a lower opening 25 toward the bottom of the container; and (iii) a bottleneck 24, which is the narrowest portion of the groove, located in between upper opening 23 and lower opening 25, and is generally on the right side of its corresponding lower opening. (Type-A groove 22A has an upper opening 23A, a bottleneck 24A, and a lower opening 25A; each of type-B grooves 22B has an upper opening 23B, a bottleneck 24B, and a lower opening 25B.) The leftmost points 26 of bottlenecks 24 are evenly spaced around exterior surface 15.

Let $w_1$ be the spacings between the leftmost points 26;

$w_2$ be the minimum width of type-A bottleneck 24A;

$w_3$ be the minimum width of type-B bottleneck 24B;

$W_4$ be the minimum width of type-B lower opening 25B;

$R_1$ be the radius of the exterior surface 15; and $t_1$ be the radial thickness of protrusions 21.

As shown in FIG. 1, the closure has a top panel 31 and a cylindrical closure side wall 33, integrally formed therewith and depending from the periphery thereof. Top panel 31 has a lower surface 32. Side wall 33 has an interior surface 34 and an exterior surface 35. For any element found on this interior surface 34, its left side is defined as the side on the left when we view it toward closure central axis 4, through side wall 33.

Figure 4:
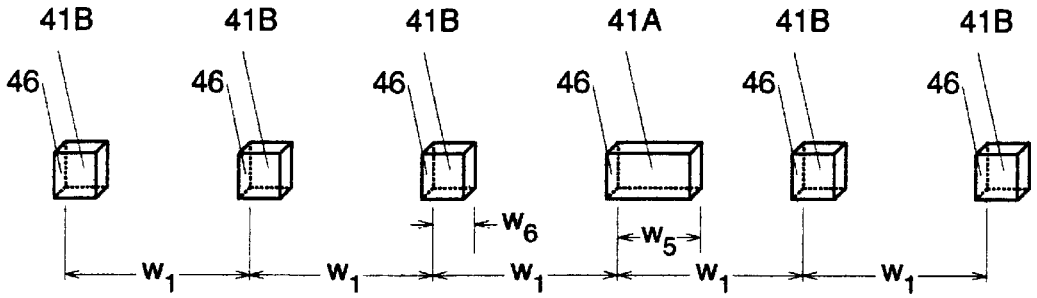
FIG. 4 is a cross-sectional view of lugs.

Radially inwardly extended from interior surface 34, axially away from top panel 31, is a type-A lug 41A and a plurality of identical type-B lugs 41B, as shown in FIG. 4. Collectively, they will be referred to as lugs 41. The number of lugs 41 is equal to the number of grooves 22. The leftmost points 46 of lugs 41 are equally spaced around interior surface 34.

Let $w_7$ be the spacings between the leftmost points 46;

$w_5$ be the maximum width of type-A lug 41A;

$w_6$ be the maximum width of type-B lugs 41B;

$R_2$ be the radius of interior surface 34; and $t_2$ be the radial thickness of lugs 41.

Then we must have $$w_6<w_5; \quad (1)$$

$$w_5<w_2; \quad (2)$$

$$w_6<w_3; \quad (3)$$

$$w_3<w_5; \quad (4)$$

$$w_5<w_4; \quad (5)$$

$$R_1<R_2-t_2<R_1+t_1<R_2. \quad (6)$$

Also, the value of $(R_2-R_1)$ is a small number. The spacing $w_1$ between the leftmost points of the grooves is therefore approximately equal to the spacing $w_7$ between the leftmost points of the lugs.

Figure 5:
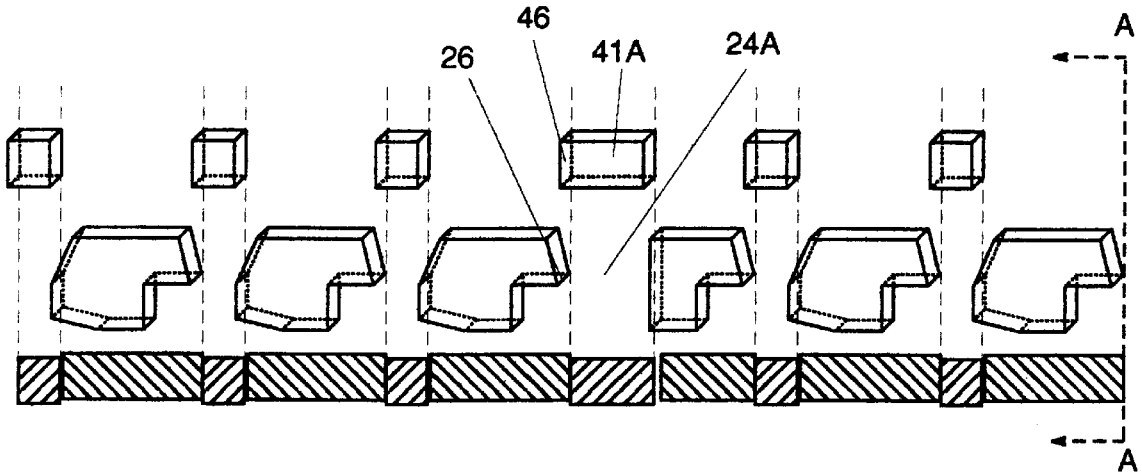
FIG. 5 is a developed view of the lugs and the grooves in their first relative rotational position.
Figure 5B:
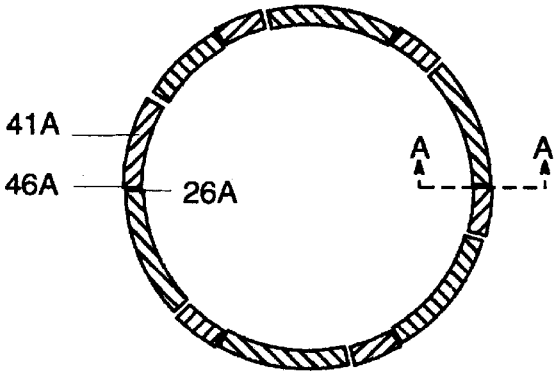
FIG. 5B is a cross-sectional view of the lugs and the grooves in their first relative rotational position.

These relationships allow type-A lug 41A to pass through type-A bottleneck 24A and type-B lugs 41B through type-B bottlenecks 24B when the leftmost point of lug 41A is generally aligned with the leftmost point of bottleneck 24A. FIGS. 5 and 5*b* show this position in developed and plan views. We say that the closure is now in its first relative rotational position with respect to the container, or the container and the closure are in their first relative rotational position.

As a means to identify this position, there is a vertical side line 16 on exterior surface 15 of the container and a vertical side line 36 on exterior surface 35 of the closure. These side lines are positioned such that the first relative rotational position occurs when they are aligned.

We will show an improved method later, but for now, this is how the closure can be engaged into the container:

Step 1: We bring the container and the closure together in such a way that the two side lines 16 and 36 are aligned; i.e., the closure is in its first relative rotational position with respect to the container.

Step 2: We push the closure down toward the container until it cannot travel any further; i.e., when lower surface 32 meets upper edge 12. We say that the closure is now in its first relative axial position with respect to the container, or the container and the closure are in their first relative axial position.

Step 3: We rotate the closure by an arbitrary angle $\theta \neq 360°$, to move it away from its first relative rotational position with respect to the container.

Figure 2:
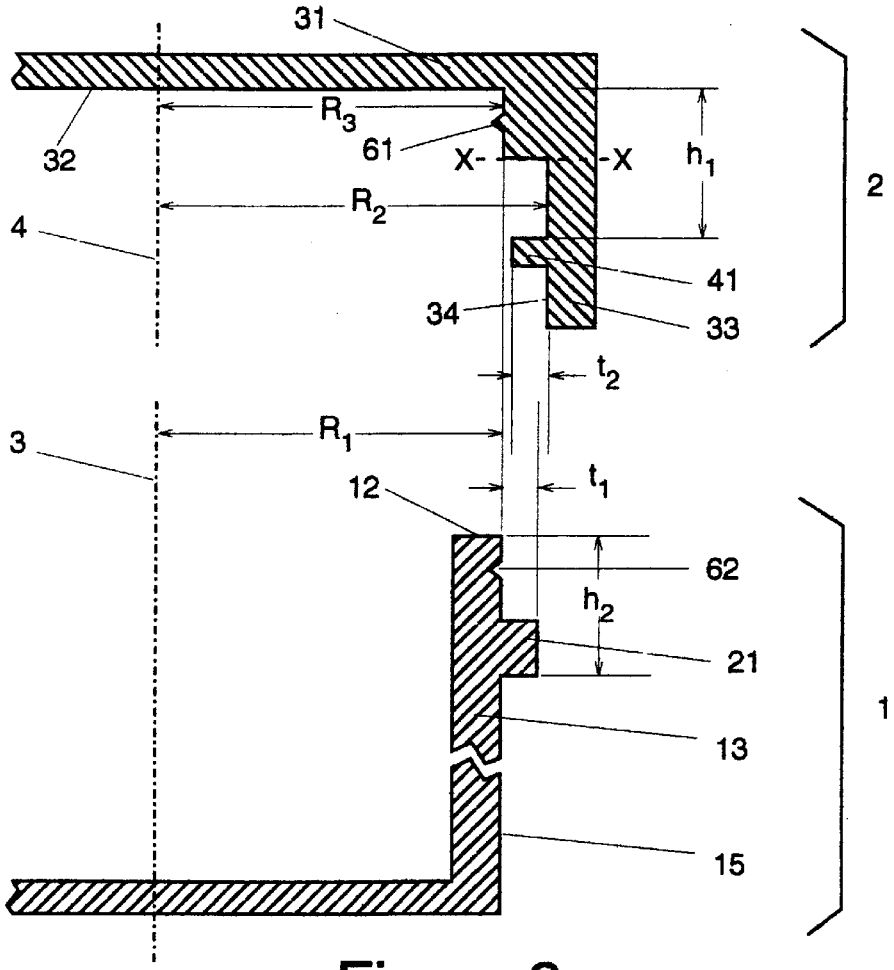
FIG. 2 is a cross-sectional view of the container and the closure.

Note that this requires that the highest points of lugs 41 be below the lowest point of protrusions 21, or, as shown in FIG. 2, $$h_1>h_2, \quad (7)$$

where $h_1$=the vertical distance between the highest point of lugs 41 and lower surface 32;

$h_2$=the vertical distance between the lowest point of protrusions 21 and upper edge 12.

Also the top of side line 16 must be far enough from upper edge 12 to permit the rotation of the closure with respect to the container by any angle.

To remove the closure from the container we only need to reverse the above process; i.e., to align the two side lines before lifting the closure away from the container. These steps do not require any strong force and are not obvious for a child, whose natural tendency would simply be lifting the closure away from the container without first aligning the two side lines. We shall now show how the present invention, together with some modifications, make it impossible for anyone to remove the closure from the container without first aligning the two side lines.

If the closure is not in its first relative rotational position with respect to the container and someone tries to separate them, then one of the following cases will develop, dependent on the initial condition; i.e., the relative rotational position of lug 41A with respect to grooves 22 before the closure being lifted.

Figure 6:
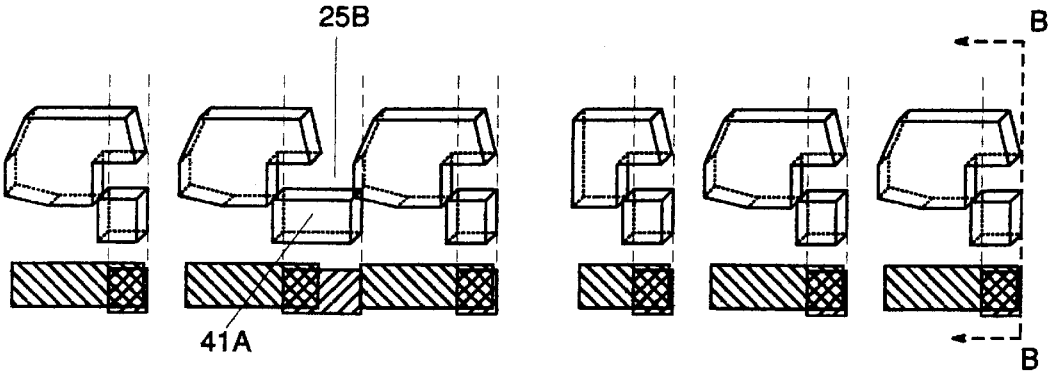
FIG. 6 is a developed view of the lugs and the grooves in their locking relative position.
Figure 6B:
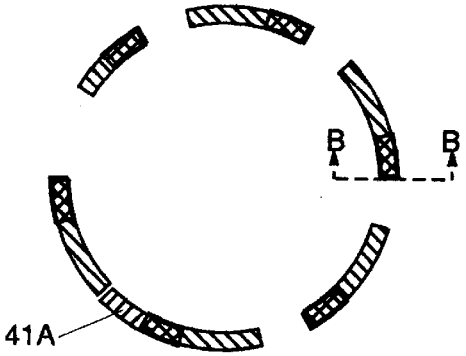
FIG. 6B is a cross-sectional view of the lugs and the grooves in their locking relative position.

Case 1: Lug 41A initially is directly underneath one of the lower openings 25B. Relationship (5) allows lug 41A to be lifted straight into that lower opening as shown in FIGS. 6 and 6B. Relationship (4) now prevents lug 41A from passing through its corresponding bottleneck 24B. Also, at this position, all lugs 41B are lifted to the left of their corresponding bottlenecks and thus also cannot pass through them. This creates a very stable situation which we shall refer to as the locking relative position of the closure with respect to the container, or the locking relative position of the container and the closure. It is extremely difficult for a child—or even an adult—to continue to lift the closure out of the container. The next natural thing for him or her to do is to rotate the former around the latter. As FIG. 6 shows, this is also impossible because lug 41A is "trapped" within that lower opening. The child normally would have to give up at this point, because the only way to open the container from here is to push the closure back into its first relative axial position, then to line up the two side lines before lifting them apart again.

Case 2: Lug 41A is initially not directly underneath one of the lower openings 25B. Now note from FIG. 3 that the bottom edge of each of those protrusions 21 on the immediate right of type-B grooves 22B has an inclined edge 27 and a level edge 28.

Figure 7B:
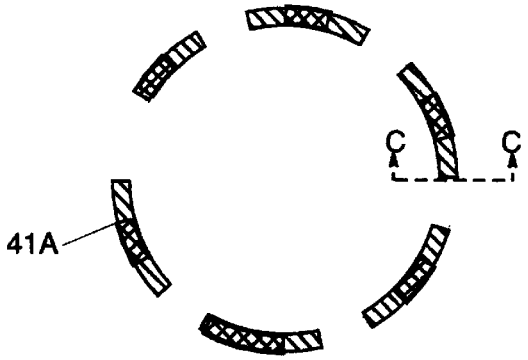
FIG. 7B is a cross-sectional view of the lugs and the grooves when the leftmost point of the type-A lug meets the level bottom edge of the protrusions.
Figure 7:
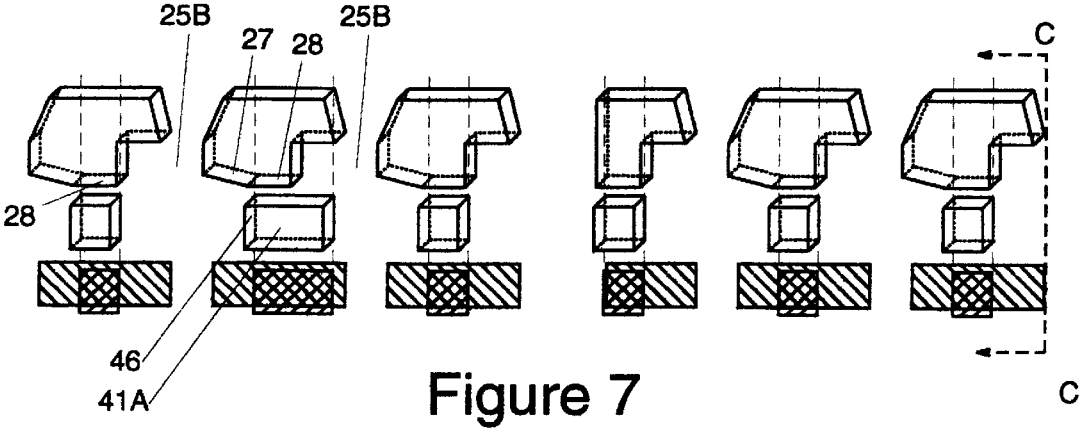
FIG. 7 is a developed view of the lugs and the grooves when the leftmost point of the type-A lug meets the level bottom edge of the protrusions.

If the leftmost point 46 of lug 41A is lifted to a level edge 28, then all other leftmost points 46 are also lifted to other level edges 28 as shown in FIG. 7. This would stop the closure from being lifted away from the container any further. If the person continues to lift the closure while turning it to the right, then lug 41A will fall into the right neighboring lower opening 25B and locking would occur as in Case 1.

Figure 8:
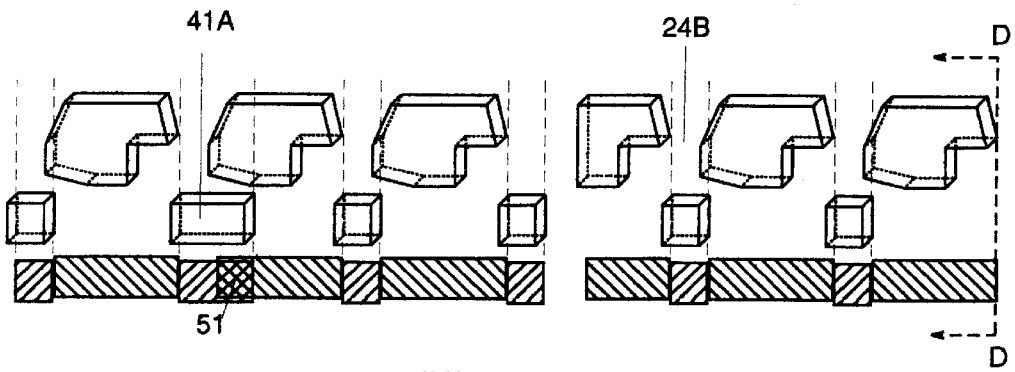
FIG. 8 is a developed view of the lugs and the grooves in their second relative rotational position.
Figure 8B:
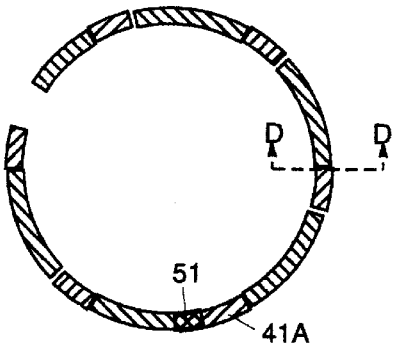
FIG. 8B is a cross-sectional view of the lugs and the grooves in their second relative rotational position.

On the other hand, if this person continues to lift the closure while turning it to the left, then inclined edge 27 would guide lug 41A into the left neighboring lower opening 25B and locking would also occur as in Case 1. There is a major problem along this left-ward journey, however. It occurs when all type-B lugs 41B pass directly under bottle-necks 24 as depicted in FIGS. 8 and 8B. At this position, the closure is said to be in its second relative rotational position with respect to the container, or the container and the closure are in their second relative rotational position. It can easily be tilted and forced out of the container because there is only one barrier 51 along this unwanted path.

Figure 9B:
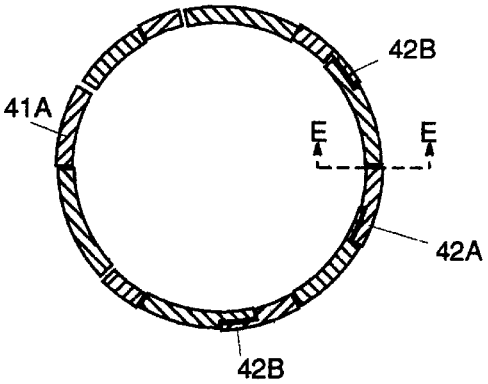
FIG. 9B is a cross-sectional view of the lugs and the grooves, including the type- C lugs and the cuts on the protrusions, in their first relative rotational position.
Figure 9:
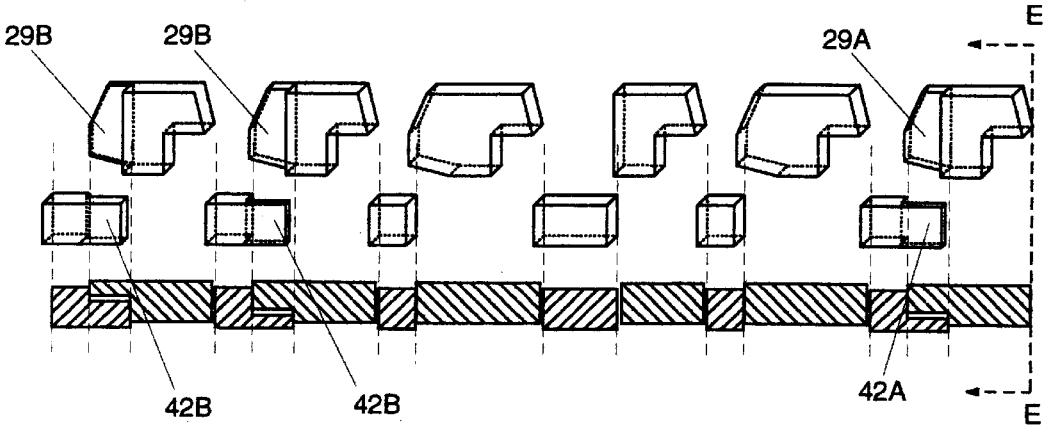
FIG. 9 is a developed view of the lugs and the grooves, including the type- C lugs and the cuts on the protrusions, in their first relative rotational position.

The solution is to create at least another barrier, preferably at a position diametrically opposite that of barrier 51. This can be achieved by introducing some type-C lugs 42 on the opposite side of type-A lug 41A as shown in FIGS. 9 and 9B. Lugs 42 are positioned immediately to the right of some type-B lugs 41B. The combination of a type-B lug and its adjacent type-C lug has a shape generally similar to that of type-A lug 41A. The radial thicknesses of these type-C lugs, however, vary and are smaller than the thickness $t_2$ of lugs 41. We found that 3 type-C lugs are sufficient: one (42A) is diametrically opposite type-A lug 41A and has radial thickness of $2t_2/3$; the other two (42B) are adjacent to the neighboring type-B lugs and have thickness $t_2/3$.

To allow the closure to be pulled out of the container in their first relative rotational position, cuts 29A and 29B must be introduced into parts of protrusions 21 to reduced their radial thicknesses accordingly, as shown in FIGS. 9 and 9B.

Since a pair of a type-B lug and a type-C lug has a shape generally similar to that of the type-A lug, together they can be accommodated inside a lower opening 25B. Thus the introduction of type-C lugs 42 does not prevent the closure from coming into its locking relative position with respect to the container as in FIG. 6.

Figure 10:
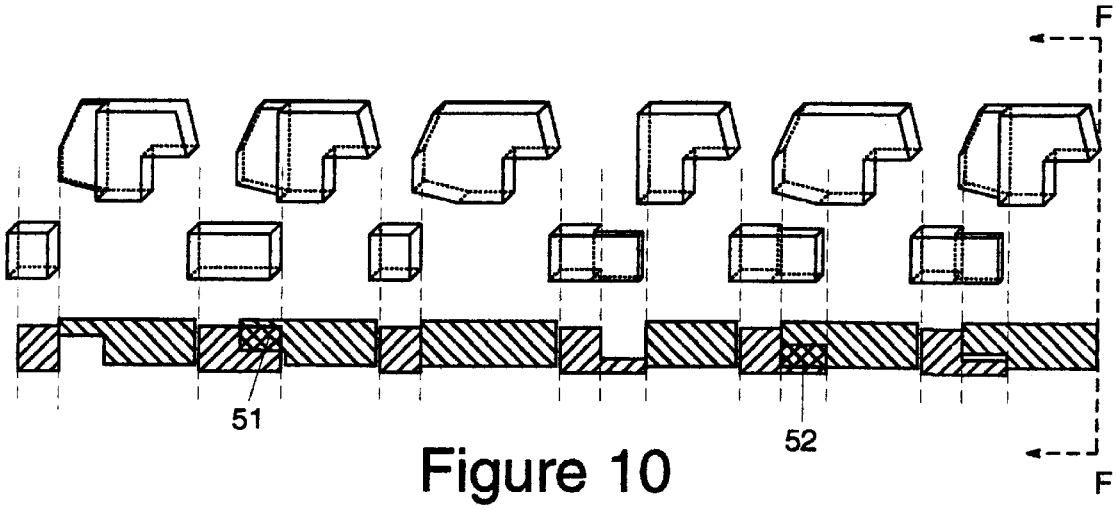
FIG. 10 is a developed view of the lugs and the grooves, including the type- C lugs and the corresponding cuts on the protrusions, in their second relative rotational position.
Figure 10B:
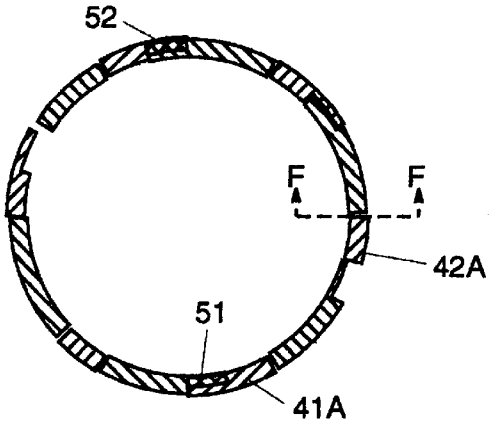
FIG. 10B is a cross-sectional view of the lugs and the grooves, including the type- C lugs and the corresponding cuts on the protrusions, in their second relative rotational position.
Figure 11:
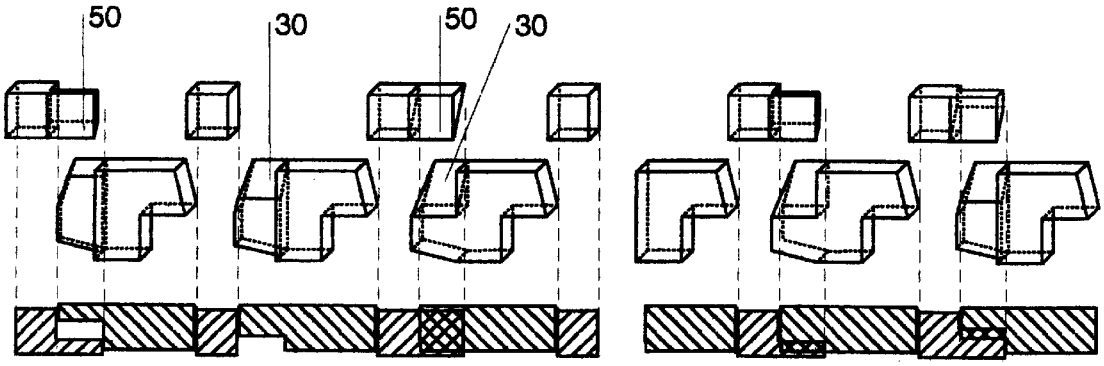
FIG. 11 is a developed view of the lugs and the grooves, including the type- C lugs, the corresponding cuts and the camming surfaces, in their second relative rotational position.

FIGS. 10, 10B and 11 now demonstrate how the introduction of type-C lugs 42 can create at least one additional barrier 52 besides barrier 51 when the closure is in its second relative rotational position with respect to the container.

We must note here that, although the second relative rotational position occurs at various relative angles between the container and the closure, it occurs only once along the left-ward journey of lug 41A from a level edge 28 to its locking position. Also, it is very temporary: even if the closure is lifted but not rotated, inclined edge 27 would rotate it out of this position. Although additional barriers 52 do not cover the whole radial thickness of the lugs, they prove to be sufficient to prevent the closure from being tilted away from its intended path.

We have now shown that, if the closure is not in its first relative rotational position with respect to the container, then lifting the former away from the latter (and rotating it in either direction) would result in locking, preventing further rotation and separation.

The present invention thus satisfies the object of providing a new combination of a container and a closure that can be opened only be persons having given instruction and skill. Once a person follows the prescribed steps, he or she does not need to exert any strong force to remove the closure from the container. The steps required are not too complicated, yet sufficiently complicated to prevent a child or a mentally disturbed person from opening the container.

Figure 12:
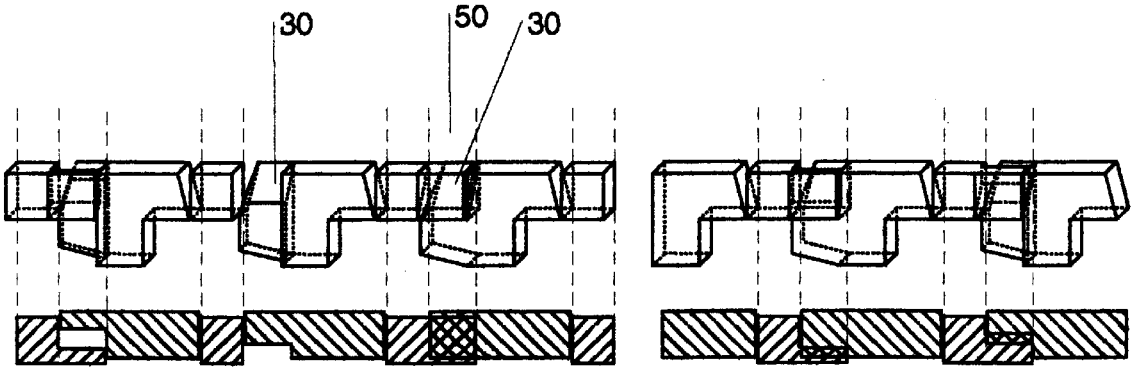
FIG. 12 shows the relative axial position of the closure with respect to the container before being snapped into the container.

A few comments are in order here:

1. A simple modification can eliminate the need to align the two side lines before engaging the closure to the container. Returning to FIG. 10, we see that the closure is prevented from being separated from the container in its second relative rotational position only by one barrier 51 and at most two barriers 52. These barriers occur because parts of lug 41A and lugs 42 "overlap" with parts of protrusions 21. All we need to do now is making these barriers effective only in one direction; i.e., only when the container and the closure are separated, but not when they come together. This can be achieved by giving these parts of lug 41A and lugs 42 camming surfaces 30 and the corresponding parts of protrusions 21 complementary camming surfaces 50 as shown in FIG. 11. While these camming surfaces can still prevent the separation of the closure from the container in its second relative rotational position, it allows the closure to be snapped into the container as in the following procedure:

Step 1: The container and the closure are brought together in an arbitrary relative rotational relation;

Step 2: If needed, the closure is rotated only by a small angle to bring it to either the first or the second relative rotational position with the container. Note that, if there are N lugs 41, there are N such positions. Upon arriving at its second relative rotational position, the closure will drop into an axial position as depicted in FIG. 12.

Step 3: The closure is pushed down to its first relative axial position.

2. The present invention should not have any problem with moisture permeability. As shown in FIG. 2, it poses no restriction on the values of $h_1$ and $h_2$ and allows as much space as needed to accommodate any kind of moisture tight seal on its side walls. For example, the radius $R_3$ of inner surface 34 near bottom surface 32 can be made just slightly larger than the radius $R_1$ of exterior surface 15. A circular bead 61 can be introduced there, to be accommodated a circular groove 62 formed on the top of the container when the closure is in its first relative axial position.

3. The present invention should be so adult-friendly that there is no need for converting it into non-child-restraint one. However, if the latter is desirable, only the part of the closure above line X—X in FIG. 2 is produced. It then can be used with the container as a "snap cap."

Figure 13:
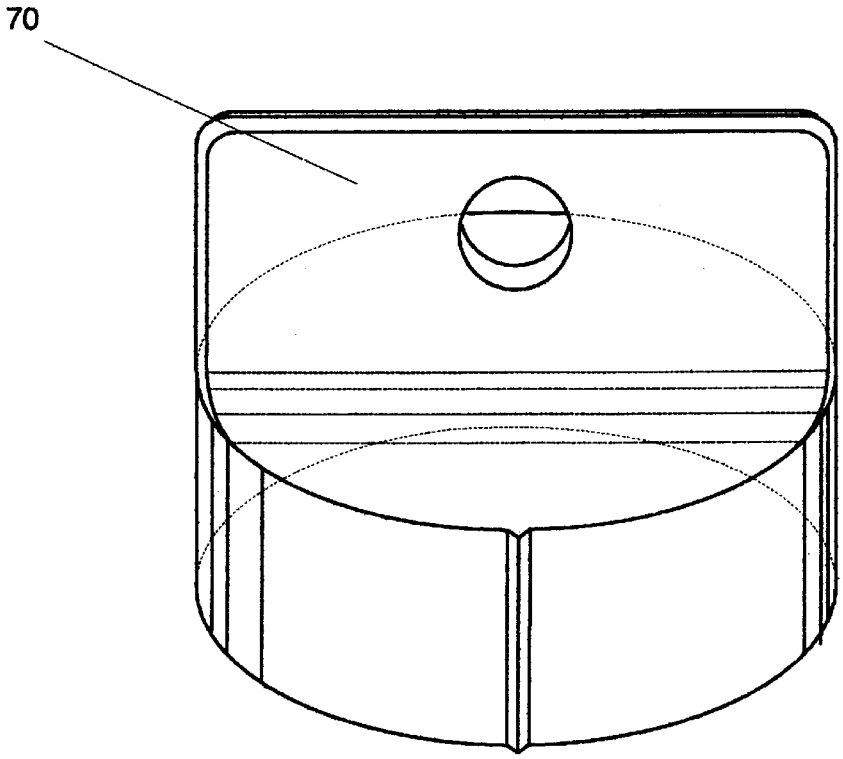
FIG. 13 is a perspective view of the closure with a wing tab.

4. A "wing tab" 70 can be introduced on top of the closure as in FIG. 13.

5. The closure's first relative rotational position with respect to the container is unique; i.e., it occurs only at one relative angle of the container and the closure (or more precisely, at a small range of relative angles), when the type-A lug is in the type-A groove, or when the two side lines are aligned. Although there is no reason to do this, but we can make more than one such positions, by increasing the number of type-A lugs and type-A grooves and distributing them evenly around the surfaces.

6. The present invention, which has only two pieces, is more economical to manufacture than the currently popular three-piece push-down-and-turn designs, such as that taught by Hedgewick and Howell, U.S. Pat. No. 3,478,911. The Hedgewick design has a plurality of locking lugs on the closure, which are cooperative with the retaining grooves on the container. It requires means to bias the locking lugs into a locking relation with the retaining grooves. This bias means normally is produced separately, then inserted inside the closure, resulting in higher material and especially assembly costs.

The present invention is also more "adult-friendly." The Hedgewick design requires the user to simultaneously exert a downward and a rotational force to the closure to engage it to, or to remove it from, the container. It has caused a lot of hardship and inconvenience to pharmacists, the elderly and those who are afflicted with arthritis, etc.

From the molding point of view, however, the lugs and protrusions of the present invention and those of Hedgewick design are generally similar. For a company who has been producing the latter, it is very easy to adapt its machinery to produce the present invention.

The present invention thus satisfies the object of providing a new and improved child-restraint combination of a container and a closure that is not too costly for design and manufacture, at least not more cost than any existing combination currently available in the market.

7. Currently, there are some designs requiring the user to align the two side lines or arrows, before tilting the closure away from the container using his or her thump. Typical is that taught by Horvath, U.S. Pat. No. 3,812,989. These designs have not been successfully adapted to prescription vials, however. As discussed by Morris, U.S. Pat. No. 3,865,267: "It is customary in the interest of convenience and cleanliness of containers to supply medicine containers to pharmacists with the closure elements in place thereon. This avoids separation and loss of the parts and assures that the interiors of the containers are in a clean condition at the time of being filled. In the case of child-resistant closures, a rather serious problem has arisen in connection with the necessity for the pharmacist to constantly remove the safety closure from the container prior to filling the latter with medicine and reclosing it. This problem concerns increasing opening time and discomfort and irritation of the fingers of the pharmacist who must manipulate the closures during an entire working day . . . The pharmacist's fingers by the end of the day are frequently very sore and uncomfortable to the extend that some of the skin may actually be damaged and this slows him up even more in opening the containers and substantially reduces the number of containers he can fill in one day."

The major difference between the present invention and Horvath design is that the present invention encourages and helps the users to lift and turn the closure simultaneously. It even provides wing tab 70 to facilitate this process. This is possible because it has a very strong and stable locking means preventing the closure from being lifted and turned simultaneously further to separation if the two side lines are not aligned first. In Horvath design, if the closure can be lifted and turned simultaneously, then sooner or latter, the two arrows will be lined up and the container will be opened. Hence only turn-without-lift or lift-without-turn is allowed for Horvath design. The former is relatively easier to achieve while the latter can only be done by restricting lifting to the use of thumps. No extra help such as a wing tab is possible.

Also, as discussed by Reifers, U.S. Pat. No. 5,292,017: "The inherent hoop strength offered by the closure skirt limits its resilient expansion thereby rendering the closure oftentimes difficult to remove by especially elderly people or those having finger dexterity or strength problems because of the necessary force required particularly for the removal of small-size snap-on closures from small-size containers. Because of their smaller size, such closures resist flexing to a greater extent compared to larger-sized closures, hence requiring a greater force to remove from its container." No such problem is in the present invention.

From the safety aspect, in locking position, the present invention is as strong and as stable as Hedgewick design and is superior to the Horvath design, which has fewer locking lugs.

Since the closure in Horvath design has to be be tilted out of the container, it must be short enough to prevent its locking lug from impacting against the top edge of the container. It also has to be short so that one cannot grasp it to simultaneously pull and rotate it to separation. This seriously limits the choice of any effective moisture sealing means on its side wall. Especially for large containers, a paper liner must be used in Horvath design. As discussed above, this is not a problem for the present invention, in which the closure is lifted straight out of the containers, with central axes 3 and 4 remain generally parallel to each other during the whole separation process.

While the principles of the present invention have now been made clear in the illustrated embodiments, those persons skilled in the art will see many modifications of structure, arrangements, proportions, elements, materials, and components used in the practice of the invention, without departing from those principles. The appended claims are therefore intended to cover and embrace such modifications within the limits only of the true spirit and scope of the invention.

I claim as my invention:

1. A child-restraint combination comprising:

(a) a container, said container having a container central axis, said container having a type-A groove, said container having a type-B groove, (b) a closure, said closure having a type-A lug, said closure having a type-B lug, said type-A lug having a type-A maximum width, said type-B lug having a type-B maximum width, said type-B maximum width being different to said type-A maximum width, (c) locking means, said closure having a locking relative position with respect to said container, said closure being in said locking relative position with respect to said container when said type-A lug is inside said type-B groove, said locking means preventing pulling said closure away from said container when said closure is in said locking relative position with respect to said container, said locking means preventing rotating said closure with respect to said container when said closure is in said locking relative position with respect to said container.

(d) opening means permitting separating said closure from said container when said closure is in said locking relative position with respect to said container, said opening means preserving the general shape of said container, (i) said closure having a first relative axial position with respect to said container, said opening means permitting moving said closure from said locking relative position with respect to said container to said first relative axial position with respect to said container by permitting pushing said closure toward said container when said closure is in said locking relative position with respect to said container, (ii) said opening means permitting rotating said closure by any angle with respect to said container as long as said closure remains in said first relative axial position with respect to said container, (iii) said closure having a first relative rotational position with respect to said container, said closure being in said first relative rotational position with respect to said container when said type-A lug can be moved into said type-A groove in a direction generally parallel to said container central axis, said opening means permitting rotating said closure to said first relative rotational position with respect to said container as long as said closure remains in said first relative axial position with respect to said container, (iv) said opening means permitting moving said type-A lug to said type-A groove, (v) said opening means permitting separating said closure from said container when said type-A lug is inside said type-A groove.

2. The combination of claim 1 wherein said opening means further including indicating means indicating whether said closure is in said first relative rotational position with respect to said container.

3. The combination of claim 2 wherein said closure further including a closure central axis, said opening means permitting pulling said closure away from said container while keeping said container central axis and said closure central axis generally parallel to each other when said closure is in said first relative rotational position with respect to said container.

4. The combination of claim 3, further including guiding means guiding said closure to said locking relative position with respect to said container when said closure is not in said first relative rotational position with respect to said container and is pulled away from said first relative axial position with respect to said container.

5. A child-restraint combination comprising:

(a) a container, said container having a container central axis, said container having a type-A lug, said container having a type-B lug, said type-A lug having a type-A maximum width, said type-B lug having a type-B maximum width, said type-B maximum width being different to said type-A maximum width, (b) a closure, said closure having a type-A groove, said closure having a type-B groove, (c) locking means, said closure having a locking relative position with respect to said container, said closure being in said locking relative position with respect to said container when said type-A lug is inside said type-B groove, said locking means preventing pulling said closure away from said container when said closure is in said locking relative position with respect to said container, said locking means preventing rotating said closure with respect to said container when said closure is in said locking relative position with respect to said container.

(d) opening means permitting separating said closure from said container when said closure is in said locking relative position with respect to said container, said opening means preserving the general shape of said container, (i) said closure having a first relative axial position with respect to said container, said opening means permitting moving said closure from said locking relative position with respect to said container to said first relative axial position with respect to said container by permitting pushing said closure toward said container when said closure is in said locking relative position with respect to said container, (ii) said opening means permitting rotating said closure by any angle with respect to said container as long as said closure remains in said first relative axial position with respect to said container, (iii) said closure having a first relative rotational position with respect to said container, said closure being in said first relative rotational position with respect to said container when said type-A lug can be moved into said type-A groove in a direction generally parallel to said container central axis, said opening means permitting rotating said closure to said first relative rotational position with respect to said container as long as said closure remains in said first relative axial position with respect to said container, (iv) said opening means permitting moving said type-A lug to said type-A groove, (v) said opening means permitting separating said closure from said container when said type-A lug is inside said type-A groove.

6. The combination of claim 5 wherein said opening means further including indicating means indicating whether said closure is in said first relative rotational position with respect to said container.

7. The combination of claim 6 wherein said closure further including a closure central axis, said opening means permitting pulling said closure away from said container while keeping said container central axis and said closure central axis generally parallel to each other when said closure is in said first relative rotational position with respect to said container.

8. The combination of claim 7 further including guiding means guiding said closure to said locking relative position with respect to said container when said closure is not in said first relative rotational position with respect to said container and is pulled away from said first relative axial position with respect to said container.

* * * * *